United States Patent [19]

Zimmern

[11] 4,364,714

[45] Dec. 21, 1982

[54] PROCESS TO SUPERCHARGE AND CONTROL A SINGLE SCREW COMPRESSOR

[75] Inventor: Bernard Zimmern, Neuilly sur Seine, France

[73] Assignee: Uniscrew Limited, Hamilton, Bermuda

[21] Appl. No.: 156,110

[22] Filed: Jun. 3, 1980

[30] Foreign Application Priority Data

Jun. 19, 1979 [FR] France ..... 79 15675

[51] Int. Cl.[3] ..... F04C 29/10; F04B 49/02; F01C 1/10; F25B 31/00

[52] U.S. Cl. ..... 417/53; 417/286; 417/310; 417/440; 418/159; 418/195

[58] Field of Search ..... 418/195, 159; 417/440, 417/310, 286, 53

[56] References Cited

U.S. PATENT DOCUMENTS

| | | | |
|---|---|---|---|
| 2,817,396 | 12/1957 | Booth | 417/286 X |
| 3,551,082 | 12/1970 | Zimmern | 418/195 |
| 4,043,704 | 8/1977 | Zimmern | 417/62 |
| 4,074,957 | 2/1978 | Clarke et al. | 418/159 |
| 4,261,691 | 4/1981 | Zimmern et al. | 418/195 X |

*Primary Examiner*—Richard E. Gluck
*Attorney, Agent, or Firm*—Ziems and Walter

[57] ABSTRACT

A process to supercharge and control a compressor comprising a single screw co-operating with at least two pinions in order to constitute as many partial compressors as there are pinions, such partial compressors operating in parallel and one of them at least being provided with a delivery control device, wherein the supercharging flow is injected into only one of the partial compressors and the delivery of the compressor is controlled from maximal delivery by reducing at first the deliveries of those partial compressors into which the supercharging flow is not injected.

2 Claims, 9 Drawing Figures

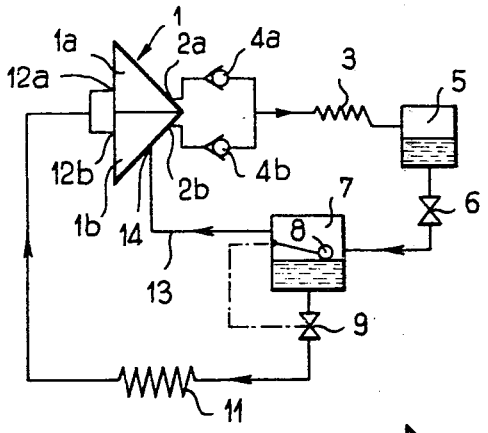
FIG_1
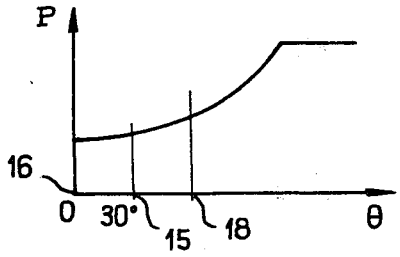
FIG_2
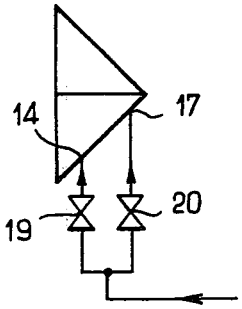
FIG_3
FIG 7
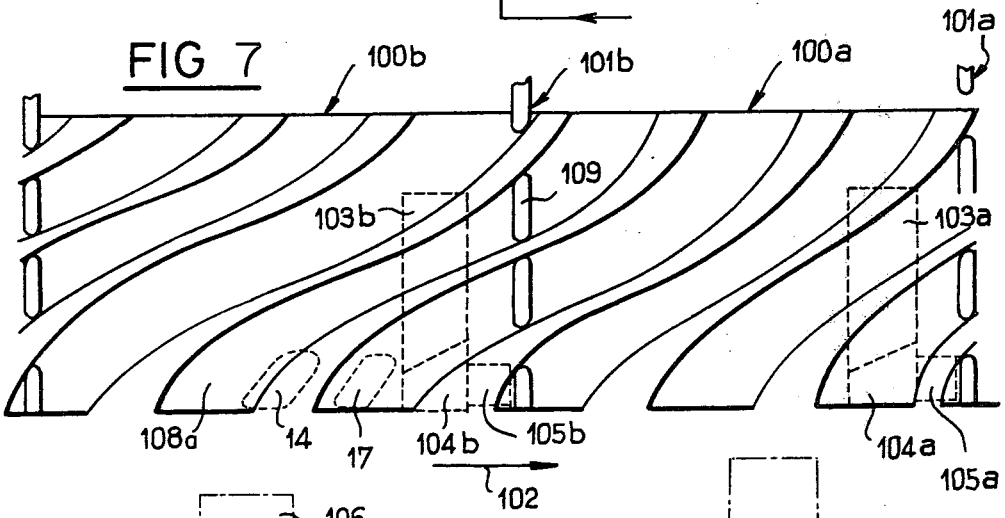
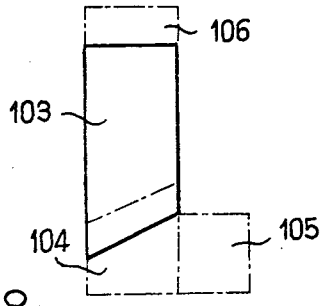
FIG_8
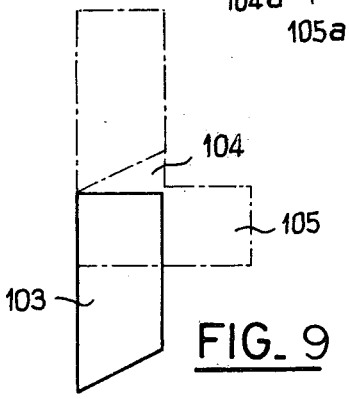
FIG_9

FIG_4
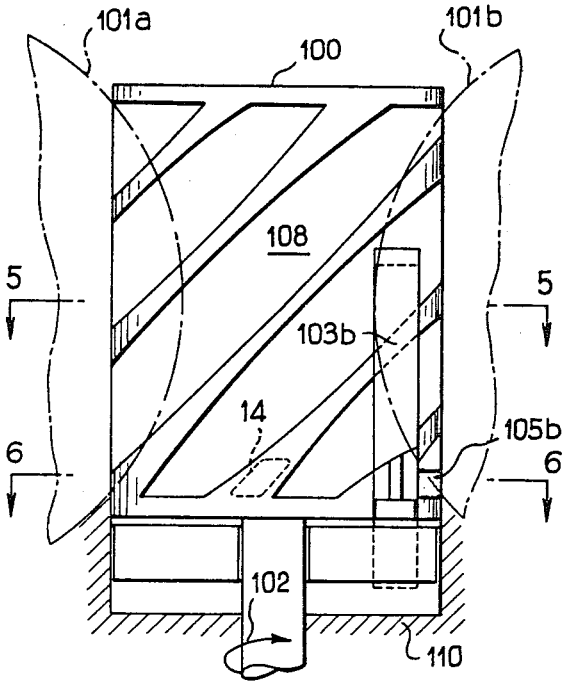
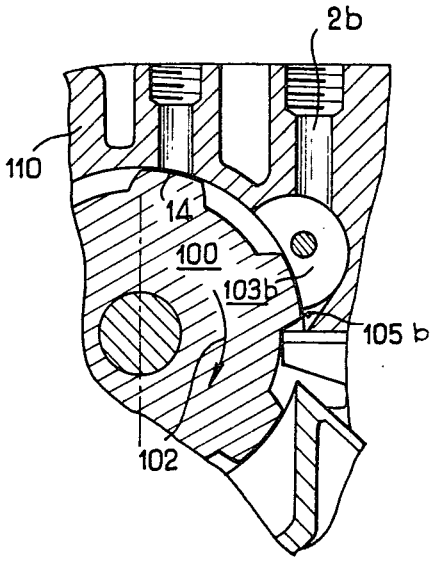
FIG_6
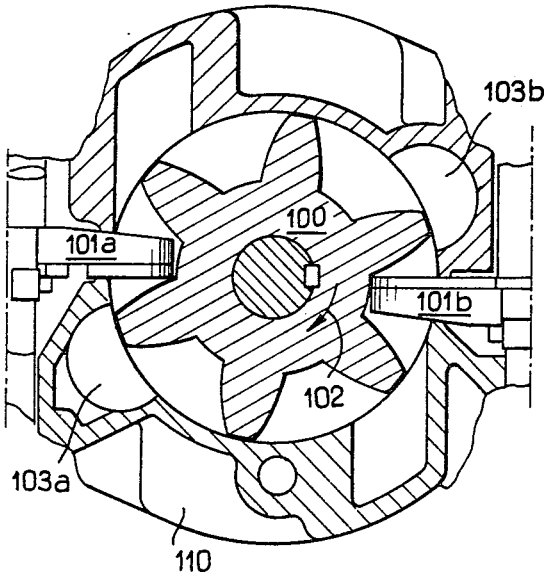
FIG_5

PROCESS TO SUPERCHARGE AND CONTROL A SINGLE SCREW COMPRESSOR

This invention relates to a process for supercharging and controlling a single screw compressor.

"Control" means, in the present specification adjusting the delivery to a preset value, variable at any moment as a result of a variable demand, and not performing a permanent adjustment on the compressor.

It is known that, in such compressors, the screw meshes with at least one pinion wheel (and most often with two such wheels) in order to constitute, by the co-operation of the threads with the casing and the engaged pinion teeth, compression chambers the volume of which diminishes while the teeth progress in the threads.

The invention principally applies to the case where such a compressor is used in a refrigeration device, and discharges into a condenser where the gaseous media condense. The condensed media accumulate in a receiver, then pass an expansion valve and are then sent to an evaporator where they are boiled off and returned as a gas to the compressor.

It is known in the art to improve the efficiency of screw compressors by expanding the condensed refrigerant at an intermediate pressure, between condenser and evaporator pressure, separating the gas released during the expansion, forwarding the liquid to the evaporator, and returning said gas into the compressor through one or several supercharging orifices, arranged in the casing at a location isolated from the suction area, but in the initial compression zone, at a pressure intermediate compressor suction and discharge pressures.

The work performed by the compressor is thus slightly increased, but the mass of gas swept by the compressor is increased in much larger proportion. Therefore the thermodynamic efficiency of the compressor is improved.

The advantage of such an arrangement is nevertheless limited in screw compressors by the means generally used to control their delivery. These known control means generally comprise slides such as described in the U.S. Pat. No. 4,074,957, such slides being moved to delay the starting point of the compression, which results in connecting the supercharging orifice with threads of the screw that are still in communication with the compressor intake. Except if the supercharging orifice is moved with the slide, which proves complicated, the result is that supercharging is possible only near full load operation of the compressor. On the other hand, part load operation is most frequently incurred in actual practice.

It is an object of this invention to achieve a process permitting the supercharging of a screw compressor while maintaining a capability to control its capacity over a wide range.

The process according to the invention is thus intended to supercharge and control a compressor comprising a single screw co-operating with at least two pinions in order to constitute as many partial compressors as there are pinions. These partial compressors operate in parallel and at least one of them is fitted with a delivery control device. The process is characterized by injecting the supercharging flow into a single one of said partial compressors, and by controlling the delivery of the compressor from maximal delivery, by reducing at first the deliveries of those partial compressors into which the supercharging flow is not injected.

The control thus operates on a gaseous loop distinct from the one which is affected by the supercharging. Thus, the respective control and supercharging operations do not interact. Moreover it will be shown herebelow, in detail, that such an unsymmetrical way to proceed results in no harmful effect on the efficiency of the system.

According to a preferred embodiment of the process, the delivery of the partial compressor in which the supercharging injection is made, is reduced to a value corresponding to to an intermediate position of the control device of said partial compressor, and the injection orifice is effectively shifted towards the downstream section of the compressor to a point where this orifice is not connected to the suction of the compressor at said intermediate position of the control device.

It is, for instance, possible to reduce, for instance, by one half, for example, the delivery of the supercharged partial compressor. While taking into account the 50% reduction obtained by the preceding operation, it will become apparent that the delivery can be reduced to 25% of the full capacity; below this rate the economic advantages of the supercharging become negligible.

Other characteristics and advantages of the invention will also become apparent from the following detailed description.

In the attached drawings, given by way of non limiting examples:

FIG. 1 is a diagrammatic view of a compressor implementing the process according to the invention, and embodied in a refrigeration circuit, FIG. 2 is a diagram of the compression taking place in this compressor, representing the pressure p in a thread of the screw as a function of the angle $\theta$ by which the screw has been rotated from the position where this thread has been isolated from suction, FIG. 3 is a diagrammatic drawing of the compressor of FIG. 1 according to an alternate version of the process, FIG. 4 is a schematic view illustrating the orientation of various components relative to a side elevation of the screw, FIG. 5 is a fragmentary cross-section on line 5—5 of FIG. 4, FIG. 6 is a fragmentary cross-section on line 6—6 of FIG. 4, FIG. 7 is a developed view of the screw of the compressor equipped with a slide delivery control system, FIGS. 8 and 9 display specific positions of the slide.

Referring to FIG. 1, the refrigeration system comprises a compressor 1 of a type comprising a single screw co-operating with two pinions, such as described in U.S. Pat. Nos. 3,180,565 or 3,551,082. It is to be considered that such a compressor is indeed formed by two partial compressors 1*a* and 1*b*, each of them corresponding to one of the pinions engaging with the screw.

Two discharge ports, respectively 2*a* and 2*b* are connected with a condenser 3 through two one-way valves 4*a* and 4*b*, such condenser being connected to a receiver 5 of the liquefied refrigerant. The receiver 5 communicates through a first expansion valve 6 with a tank 7 at intermediate pressure, fitted with a float 8 controlling a second expansion valve 9 which admits the fluid into an evaporator 11 which is, in turn, connected to the suction ports 12*a* and 12*b* of the partial compressors 1*a* and 1*b*.

The upper part of the tank 7 is connected through piping means 13 to a supercharging orifice 14 arranged in the casing of the compressor 1, in the part corresponding to the half-compressor 1*b*, at a location that will be defined later more precisely.

When the compressor operated at full load, the compressed gas issuing from the two partial compressors 1*a* and 1*b* are condensed in condenser 4 and the liquid is collected in the receiver 5. From there, the liquid enters the tank 7 whilst vaporizing in part due to expansion in the valve 6. The liquid cooled by the expansion is admitted to the evaporator 11, whereas the gas (or vapor) released in the tank 7 is sent through the pipe 13 to the supercharging orifice 14.

The supercharging orifice 14 is located at a point of the compressor casing that, in operation, is isolated from the intake 12*b* by a tooth of the pinion of the partial compressor 1*b*. This point is preferably located near the beginning of the compression travel of said tooth. Due to the fact that a given point of the casing co-operates with a thread during a given angle of rotation of the screw, which is in the order of magnitude of 60° for a six-threaded screw, it follows that if the supercharging orifice 14 is to be located at a point always isolated from suction by a tooth of pinion, but where the pressure is reduced as much as possible, the coincidence during rotation between the center of this orifice and the center of the groove must be at a point 15 (FIG. 2) corresponding to a rotation of the screw of approximately 30°, starting from point 16 where the tooth of the pinion has just closed the thread.

It is also to be noted that the angle of 60° referred to may be reduced if the point of the casing under consideration is located in the area where the top or crest of the thread has a larger width, as in such case the hollow part or groove of the thread covers a shorter angular distance.

At that moment, if it is desired to reduce the delivery of the compressor, by cancelling the compression by a lifting of the pinions or by continuous moving of a section of the casing (as described in U.S. Pat. No. 4,074,957, such an operation leads to displace the closing point 16 towards the left of FIG. 2 to delay the beginning of the compression, and thus to connect the supercharging orifice 14 with suction, which is equivalent to cancelling the supercharging.

In the usual case where the compressor is fitted with an on-off control system of the pinion-lifting type on the two partial compressors, the method in accordance with this invention is characterised by diminishing the delivery of the compressor by cancelling at first the compression effect of the partial compressor 1*a*.

In this way, two delivery levels are obtained, 100% and 50%, the supercharging being maintained at both levels. It is also possible to obtain 0% by equally lifting the pinion of the partial compressor 1*b*.

Intermediate levels are obtainable also by placing a hole in the compressor casing, in the casing part corresponding to the partial compressor 1*a* and by returning to the suction side of the compressor the gas delivered by this hole so as to compress, for instance, only half of the volume of the screw thread grooves. An intermediate level at 75% is thus obtained whilst still keeping the supercharging.

A 25% level is also available by lifting the pinion of the partial compressor 1*b* and operating the partial compressor 1*a* at its intermediate level, but then the advantage of the supercharging is lost.

The method in accordance with the invention will be described now in the event of the compressor being fitted with a control system according to U.S. Pat. No. 4,074,957. For clarification purposes, the principle of such a system will be summarized below with reference to FIGS. 4 to 9.

FIGS. 4 and 5 are substantially reproductions of FIGS. 1 and 6, respectively and U.S. Pat. No. 4,074,957 modified to include the supercharging orifice 14 (FIG. 1) and other reference numeral designations applicable to FIGS. 1–3 and 7–9. Thus in FIGS. 4 and 5, a single screw 100 is shown in operative relationship with two pinions 101*a* and 101*b*, the screw 100 and pinions 101 being rotatably supported by a casing 110. In accordance with conventional screw compressors of this type, the two surfaces of the several threads on the screw 100 seal with the cylindrical interior chamber of the casing whereas the teeth on the pinions 101*a* and 101*b* seal at least on one surface with the casing as well as with the flank and bottom surfaces of thread grooves 108. As the screw 100 rotates in the direction of the arrow 102, for example, both pinions 101*a* and 101*b* are caused to rotate so that the pinion teeth sweep each groove by entry into the respective grooves at the top of the screw 100 and exit from the grooves 108 at the bottom of the screw 100 as it is oriented in FIG. 4.

In accordance with the teaching of U.S. Pat. No. 4,074,957, the compressor illustrated in FIGS. 4–6 is provided with a pair of slides 103*a* and 103*b* to control compressor capacity. The slides 103*a* and 103*b* cooperate with a fixed discharge port 105*a* and 105*b*, respectively, in a manner to be described in more detail below. As may be seen in FIG. 6, the supercharging orifice 14 opens to a passageway in the housing 110. Similarly, the discharge to be is shown in fluid communication with the fixed discharge port 105*b* in FIG. 6.

FIG. 7 represents a planar development of the whole screw periphery with two zones 100*a* and 100*b* respectively corresponding to the half-compressors 1*a* and 1*b* and two pinions 101*a* and 101*b* limiting these zones, the teeth of which mesh with the threads of the screw. In other words and in practice, the zones 100*a* and 100*b* in FIG. 7 extend about the screw periphery through arc lengths determined by the angular spacing of the pinions (in this instance 180°) and each such zone in the composite compressor constitutes a partial compressor represented in FIG. 1 by the half compressors 1*a* and 1*b*. During normal operation, the threads move in the direction of arrow 102.

The above mentioned control system comprises two slides 103*a* and 103*b* provided in the casing and depending on their position, will provide variable discharge orifices 104*a* and 104*b* next to fixed discharge orifices 105*a* and 105*b*.

In FIG. 8 is shown a slide 103 which has been partially moved, thereby unmasking an orifice 106 by which the gas, at the beginning of compression, returns to intake, whilst the variable orifice 104 is partially closed.

In FIG. 9, the slide 103 is completely pushed forward and the whole groove 108 is permanently connected to the intake, so that there is no more compression.

FIG. 7 shows the supercharging orifice 14, which is inscribed within the width of the top or crest of a screw thread and which communicates with the hollow or groove 108*a* when said hollow is cut off from intake (the top end of the screw in FIG. 4) by a tooth of a pinion 109, according to the arrangements above explained.

As formerly mentioned, it is interesting, in order to improve the efficiency, to locate the supercharging orifice 14 in such a manner that it begins registering with the groove 108*a* as soon as the latter is closed off by the tooth 109. But it results therefrom that, as soon as the slide 103*b* is moved, the groove is simultaneously connected with the orifice 14 and the return passage 106, hereby making supercharging unpracticable.

Consequently, if the process according to the invention is applied to a compressor fitted with a control device provided with slides, said process contemplates continuously controlling the capacity by acting only on the slide 103*a* relating to the partial compressor 1*a* which is free of supercharging orifice, without moving the slide 103*b* relating to the partial compressor 1*b*. By effecting a complete displacement of the slide 103*a* a continuous control of the delivery from 100% to 50% is possible while keeping the benefit of the supercharging.

Moreover the present invention yields an unexpected result. Using a single supercharging orifice instead of two would normally be expected to decrease the efficiency of the system because injecting the supercharging flow ordinarily provided for two partial compressors into the threads of a single partial compressor causes an increase in the mean pressure in the supercharged groove and thus in the tank 7.

Further, one would ordinarily expect an increase of the temperature in the tank 7, a decrease in the quantity of gas injected in the supercharging orifice and an increase of the gas unnecessarily delivered to the evaporator, which is thus to be totally recompressed by the compressor instead of being only partly recompressed when injected through the supercharging orifice.

But experimental results establish that, in spite of this phenomenon which occurs in fact, another beneficial phenomenon more than compensates for this expected deterioration.

It has been indeed verified that injecting gas into the threads by the supercharging means increase the volumetric leakages from the compressor, but that said leakages were notably smaller when the same flow is injected in only one partial compressor instead of two partial compressors.

For example, in a single screw compressor having a volume of 1600 liters swept at 3000 rpm and compressing a refrigerant, specifically Freon 22 from 3 to 12 bar, the supercharging made through two orifices of approximately 1.5 $cm^2$ each results in re-injecting the gas under a mean pressure of 5.1 bar.

It derives therefrom the possibility to re-inject through these orifices into the compressor approximately 20.4% of the intake gas, at the cost of an increase in absorbed power of approximately 5% and a reduction of the compressor delivery (when compared to the delivery without supercharging) of approximately 8%, so that the energetic gain brought about by the supercharging is approximately $20.4\% - 5\% - 8\% = 7.4\%$. When injection is performed through a single orifice of 2 $cm^2$, the mean pressure prevailing in the supercharged thread increases to 5.8 bar, and the percentage of re-injected gas decreases to 18%, the increase in absorbed power remains approximately the same i.e. 5%, but the reduction in delivery is now only 5%, so that the energetic gain brought about by the supercharging becomes $18\% - 5\% - 5\% = 8\%$. It is thus clear that the efficiency remains approximately unaltered.

Moreover it is possible to extend the benefit of supercharging to deliveries reduced below 50% by moving the orifice, either in a continuous manner by arranging it on a slide, or as shown in FIG. 3 by providing a second orifice 17 corresponding in the compression diagram of FIG. 2 to a point 18 more remote from point 16 thant the point 15, so that the point 17 remains separated from suction over a part of the stroke of the slide relating to the partial compressor 1*b*. For instance, it can be made that orifice 17 registers with the thread only when the latter's volume has been reduced to one half of its total volume.

When delivery drops below 50%, a valve 19 (FIG. 3) associated with the orifice 14 is closed and a valve 20 associated with the orifice 17 is open.

Such an arrangement allows extending the benefit of supercharging down to the point where the threads of the partial compressor 1*b* are half filled, i.e. a delivery of 25%, under which rate the economic advantages of supercharging become negligible, due to the fact that the compressor usually operated very seldom under this value.

It is to be understood that, in the scope of the instant invention, the separation of the gas at an intermediate pressure may be achieved in several manners different from using a tank 7 with a float. For instance a centrifugal separator can be used or according to a conventional practice in two-stage devices, by boiling off a part of the liquid at the intermediate pressure and by subcooling through an exchanger the rest of the condensed liquid.

The present invention would not be altered if, instead of two pinions and thus two partial compressors there were three of them and one or two supercharging orifices distributed over these three partial compressors, similarly instead of compressors with cylindrical screws and plane pinions such as described in U.S. Pat. No. 4,074,957, it is possible to make use of compressors with cylindrical, conical or plane screws with plane or cylindrical pinions such as described in U.S. Pat. Nos. 3,180,565 or 3,551,082 for example.

I claim:

1. A process for supercharging and controlling a composite compressor having a single screw cooperating with at least two pinions to provide a plurality of partial compressors equal in number to the number of said pinions, at least one of said partial compressors having means for controlling the delivery thereof, said process comprising the steps of:

injecting into a single one of said partial compressors a supercharging flow of gas at pressures intermediate compressor intake and discharge pressures; and varying the delivery of said composite compressor from maximum delivery thereof by first reducing the deliveries of said partial compressors other than said single one partial compressor into which said supercharging flow is injected.

2. The process recited in claim 1 comprising the step of further varying the delivery of said composite compressor from maximum delivery by reducing the delivery of said single one partial compressor and shifting the point of injecting the supercharging flow into said single one partial compressor to a location at which the supercharging flow is isolated from the intake of said single one partial compressor.

* * * * *